United States Patent [19]

Yoshiga

[11] Patent Number: 4,612,795

[45] Date of Patent: Sep. 23, 1986

[54] METHOD OF FORMING A GROOVE IN A VALVE SEAT AND THE TOOL USED IN THIS METHOD

[75] Inventor: Kenji Yoshiga, Funabashi, Japan

[73] Assignee: Fuji Koki Manufacturing Co., Ltd., Tokyo, Japan

[21] Appl. No.: 663,975

[22] Filed: Oct. 23, 1984

[30] Foreign Application Priority Data

Oct. 27, 1983 [JP] Japan ..... 58-201370

[51] Int. Cl.[4] ..... B21J 13/02

[52] U.S. Cl. ..... 72/478; 29/157.1 R

[58] Field of Search ..... 29/157.1 R, 157 C; 72/477, 478, 112

[56] References Cited

U.S. PATENT DOCUMENTS

| | | | |
|---|---|---|---|
| 1,733,226 | 10/1929 | Jones | 29/157.1 R |
| 2,215,019 | 9/1940 | Smith | 29/157 C |
| 2,217,194 | 10/1940 | Bryce et al. | 29/157 C |
| 2,224,670 | 12/1940 | Criley | 72/478 |

OTHER PUBLICATIONS

Singer Controls Division, Rm-303B, (1975), pp. 9-11.

*Primary Examiner*—Francis S. Husar
*Assistant Examiner*—David B. Jones

[57] ABSTRACT

A tool, used for forming a groove in a valve seat, having a tool main body which has a hardness greater than that of the valve seat, and an end portion with a circumferential surface which has a shape corresponding to the valve seat and is brought into linear or surface contact with the valve seat in an annular shape, and a wire which has a hardness greater than that of the valve seat and which is clamped between a circumferential edge of the valve seat and the end portion of the tool main body so as to cross the circumferential edge of the valve seat, wherein the tool main body is pressed until the circumferential surface of the end portion of the tool main body is brought into linear or surface contact with the valve seat in an annular shape and the movement of the tool main body is stopped, thereby forming an impression of the wire on the valve seat.

4 Claims, 4 Drawing Figures

METHOD OF FORMING A GROOVE IN A VALVE SEAT AND THE TOOL USED IN THIS METHOD

BACKGROUND OF THE INVENTION

The present invention relates to a method of forming a groove in a valve seat so as to allow passing of a small amount of fluid between the valve seat and a valve member even if the valve member is abutted against the valve seat, and to a tool used for this method.

Such a groove is formed, e.g., in a valve seat of an expansion valve used in a refrigeration cycle.

When the refrigeration cycle is stopped, the operation of a compressor is stopped and the supplying of a control signal to a valve opening control means of the expansion valve is also stopped. Therefore, when a groove as described above is not formed in the valve seat, high-pressure coolant is trapped between the expansion valve and the compressor. The high-pressure coolant, when trapped, imposes a load on the compressor when the refrigeration cycle is resumed and adversely affects the operation of the compressor. In a conventional method of forming a groove to prevent this problem, a tool having a pyramid-like distal end with a hardness greater than that of the surface of the valve seat is used.

In the conventional method of using such a tool, if the tool is off-centered or misaligned from the valve seat or if the stroke of the tool is not properly controlled, the size and shape of the formed groove will be different from the design. Then, the time period required for equalizing the pressure in a passage between the expansion valve and the compressor (to be referred to as an upstream passage), i.e., a passage under high pressure, to that of the coolant in a passage downstream from the expansion valve, that is, a passage under low pressure, from the time of closing the expansion valve, will deviate from the time period determined by the design of the refrigeration cycle. That is, the refrigeration cycle will be resumed before the pressure of the coolant in the upstream passage reaches a balance with that of the coolant in the downstream passage. As a result of this, the compressor may be damaged. However, if a high-precision requirement is imposed on the centering of the valve seat and the tool and the stroke of the tool, the conventional method of forming a groove in a valve seat is rendered complex in its procedure and the manufacturing cost is increased. Furthermore, in this conventional method, when the distal end of the tool wears, it must be reground to a desired size and shape irrespective of the relatively high level of hardness of the distal end. This grinding operation is complex in procedure and costly to accomplish.

SUMMARY OF THE INVENTION

The present invention has been made in consideration of this and has as its object to provide a method of forming a groove in a valve seat and a tool used in this method, wherein even if the tool is slightly off-centered from the valve seat or the stroke of the tool is not controlled with high precision, a groove of a desired size and shape can be formed in the valve seat, and even if the tool wears, the tool can be returned to a predetermined original size and shape at low cost.

The above object of the present invention can be achieved by a method of forming a groove in a valve seat. The method involves clamping a wire having a hardness greater than that of the valve seat between a circumferential edge of the valve seat and a tool main body having a greater hardness than that of the valve seat and having an end portion of a shape corresponding to the valve seat; the wire being arranged in a direction to cross the circumferential edge of the valve seat. The tool main body is pressed until a circumferential surface of the end portion of the tool main body is in linear or surface contact with the valve seat in an annular shape and the movement of the tool main body is stopped, thereby forming an impression of the wire on the valve seat. In this method, a tool is used which comprises the tool main body having a hardness greater than that of the valve seat and an end portion with a circumferential surface which has a shape corresponding to the valve seat, and the tool is brought into linear or surface contact with the valve seat in an annular shape; and a wire which has a hardness greater than that of the valve seat and which is clamped between the circumferential edge of the valve seat and the end portion of the tool main body so as to cross the circumferential edge of the valve seat, wherein the tool main body is pressed until the circumferential surface of the end portion of the tool main body is brought into linear or surface contact with the valve seat in an annular shape and the movement of the tool main body is stopped, thereby forming an impression of the wire on the valve seat.

In the method as described above, the circumferential surface of the tool main body is brought into a linear or surface contact with the valve seat in an annular manner, and the movement of the tool main body relative to the valve seat is stopped. Therefore, the control of the stroke of the tool main body need not be performed at high precision, and a slight off-centering of the tool main body from the valve seat can be corrected by the annular linear or surface contact between the two members. In this manner, as long as the wire has not become worn, a groove of a desired size and shape, i.e., a groove with a designed size and shape, can be formed in the valve seat. Furthermore, even if the wire has become worn, it can be easily replaced with a new wire which can be freely selected from those commercially available, and replacement of the wire is not costly.

The tool as described above is of a simple construction, and allows free selection of a wire and low-cost replacement of the wire.

According to the method of the present invention, it is preferable to detachably hold the wire at a top surface of the end portion of the tool main body and to move the wire together with the tool main body toward and from the valve seat.

Thus, the time required for forming a groove in the valve seat is shortened, so that the manufacturing efficiency of such valves is improved and the manufacturing cost thereof is decreased.

The preferable method as described above can be performed by detachably holding the wire at the top surface of the end portion of the tool main body and by moving the wire together with the tool main body toward and away from the valve seat.

The preferable method described above is, in particular, preferably performed with a tool wherein the wire holding means is a groove formed in the top surface of the end portion of the tool main body.

This construction simplifies the construction of the holding means, facilitates the manufacture of the holding means and also facilitates attachment/detachment of the wire to/from the holding means.

According to the method of the present invention, a relatively long wire preferably extends from a storage means for storing the wire without need for cutting to a collecting means, and preferably is clamped between the end portion of the tool main body and the valve seat at a position between the storage means and the collecting means. This preferable method can be achieved with a tool which has a storage means for storing a relatively long wire without need for cutting and a collecting means for collecting the wire and in which the wire extends from the storage means to the collecting means and is clamped between the end portion of the tool main body and the valve seat at a position between the storage means and the collecting means. With the method and tool described above, it is easy to replace a portion of a wire which has been used for forming a groove in the valve seats, and which has become worn, with a new portion of wire. Furthermore, when the wire is being used to form the groove in the valve seat, the wire can be kept in the form of a long wire. Therefore, preparation for utilizing the method, i.e., for using the tool, is easy.

The present invention will be described below with reference to the accompanying drawings.

DETAILED DESCRIPTION OF THE PREFERRED EMBODIMENTS

Figures 1, 2:
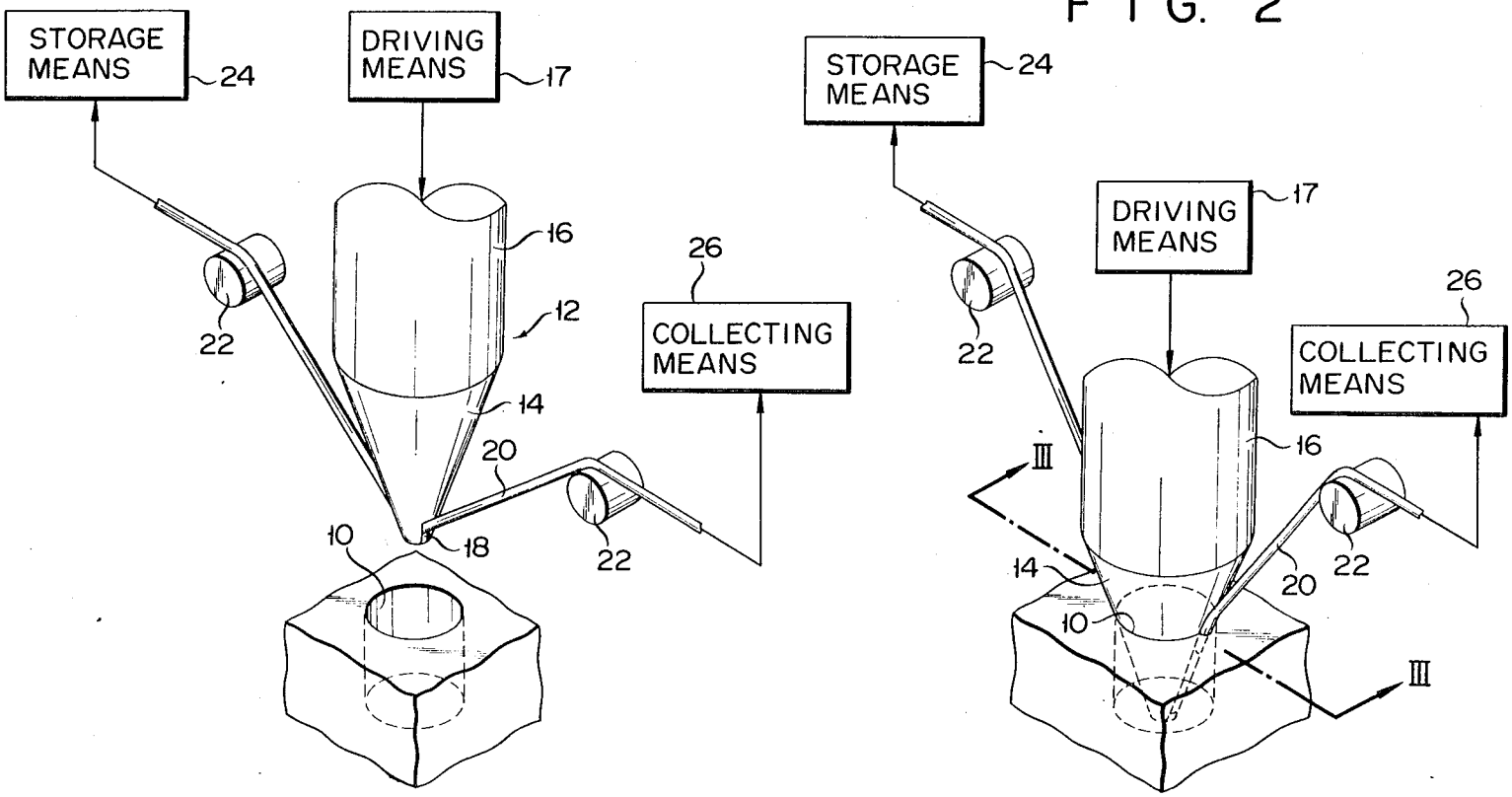
FIG. 1 is a perspective view showing a valve seat and a tool used in an example of a method of forming a groove in the valve seat according to the present invention, a tool main body and a wire being separated from the valve seat.
FIG. 2 a perspective view similar to FIG. 1 but in a state wherein after the wire is clamped between the tool main body and the circumferential edge of the valve seat in FIG. 1, the tool main body is pushed against the valve seat until the circumferential surface of the tool main body is brought into linear contact with the valve seat in an annular shape, and an impression of the wire is formed in the valve seat.

FIG. 1 shows a valve seat 10 and a tool 12 for forming a groove in the valve seat 10.

In this embodiment, the valve seat 10 has a cylindrical shape and consists of brass.

The tool 12 has a tool main body 16 with an end portion 14 of a shape corresponding to that of the valve seat 10, i.e., a conical shape in this embodiment. The tool main body 16 is supported by a support member (not shown) to be vertically movable (FIG. 1) and is biased to its uppermost position by a biasing means (not shown). The tool main body 16 is connected to a driving means 17. In response to a control signal from a control means (not shown), the driving means 17 moves the tool main body 16 downward against the biasing force of the biasing means (not shown).

The valve seat 10 is fixed by a jig (not shown) at a position below the end portion 14 of the tool main body 16 such that the valve seat 10 is substantially concentrical with the tool main body 16.

The end portion 14 adjacent the tool main body 16 has a diameter larger than that of the valve seat 10. Therefore, when the tool main body 16 is driven downward by the driving means 17 against the biasing force of the biasing means from the uppermost position shown in FIG. 1, it brings the circumferential surface of the end portion 14 in annular linear contact with the valve seat 10 such that the tool main body 16 acts as a valve member for the valve seat 10. Since the tool main body 16 is made of a material harder than that of the valve seat 10, e.g., steel, it will not wear or be damaged upon contact with the valve seat 10.

A groove 18 is formed adjacent the tip of end portion 14 of the tool main body 16 so as to extend in radial direction of the valve seat 10. A wire 20 of a material harder than that of the valve seat 10, but preferably of a material softer than that of the tool main body 16, is received in the groove 18. The groove 18 serves as a holding means for detachably holding the wire 20.

The wire 20 extends from the ends of the groove 18 and is directed to extend along the longitudinal direction of the groove 18, i.e., the radial direction of the valve seat 10, by means of guide rollers 22. One end of the wire 20 is stored by a known storage means 24 for storing a relatively long wire, e.g., a roller having the wire 20 wound around it. The other end of the wire 20 is guided to a known collecting means 26 for collecting a relatively long wire, e.g., a take-up roller. A predetermined tension is applied to the wire 20 by a known tension generating means. This tension is not so high as to prevent the movement of the tool main body 16 and allows movement of the wire 20 together with the tool main body 16 toward and away from the valve seat 10 without allowing any slackening of the wire.

Figure 3:
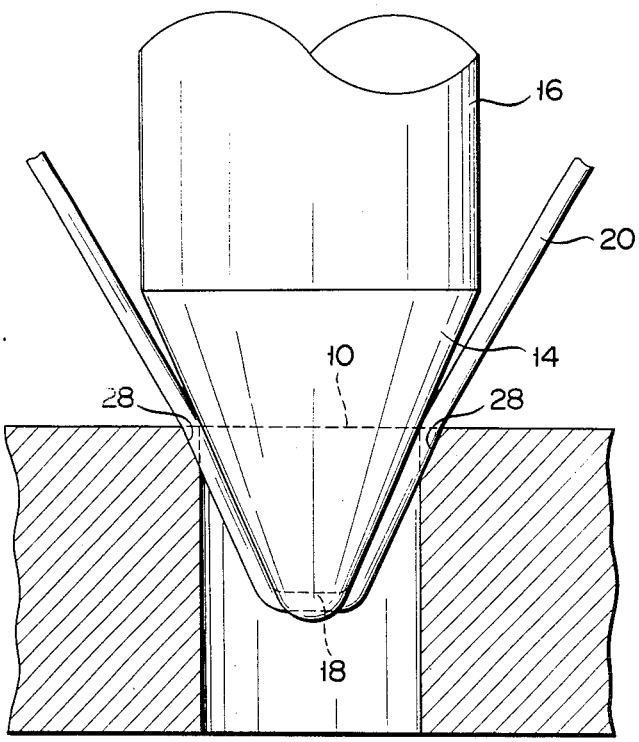
FIG. 3,is a schematic sectional view along the line III—III in FIG. 2.
Figure 4:
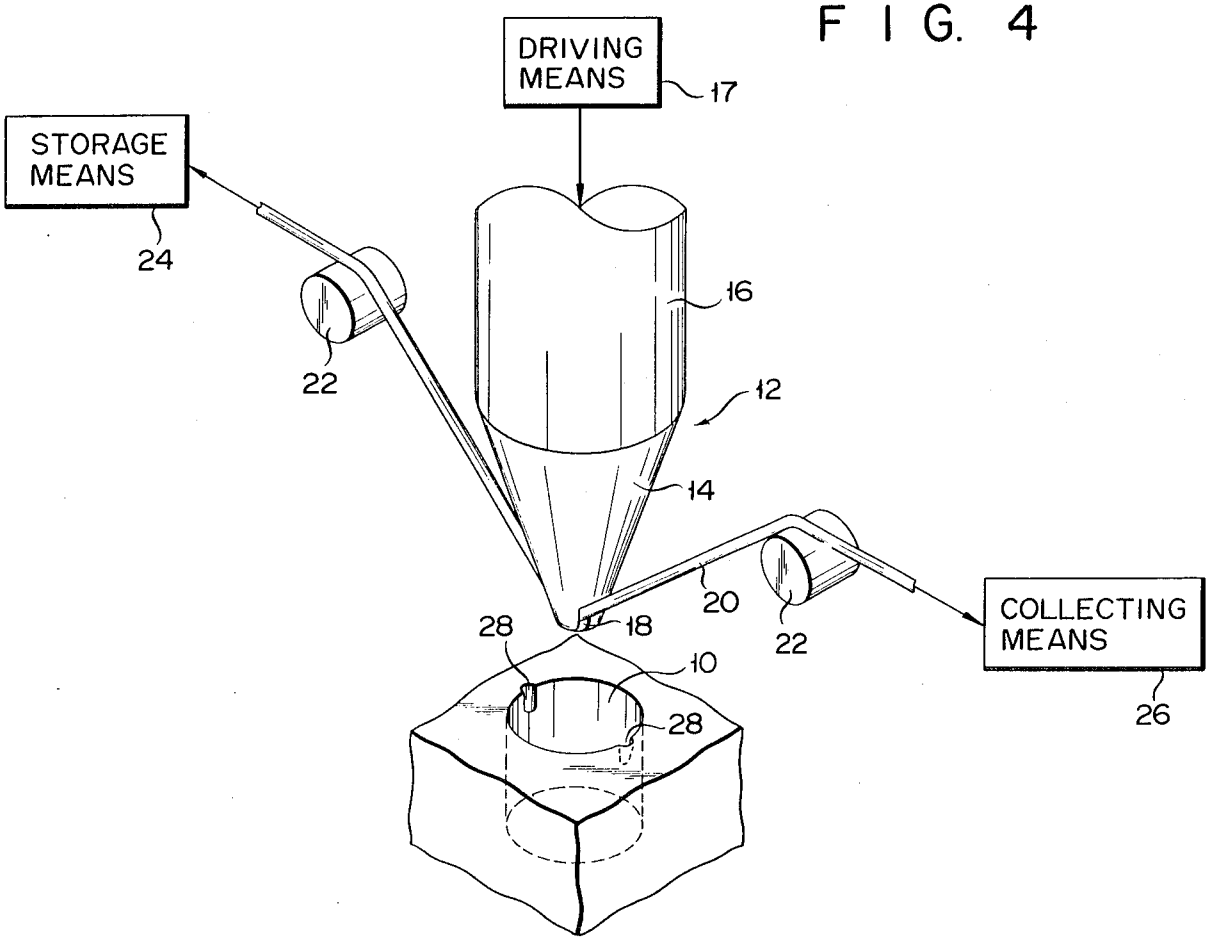
FIG. 4,is a perspective view showing a state wherein the tool main body is returned to the initial position in FIG. 1 after the impression of the wire is formed in the valve seat.

In the method of forming a groove in the valve seat 10 with the tool 12 having the construction as described above, the tool main body 16 is moved downward (FIG. 1) against the biasing force of the biasing means (not shown) by the driving means 17. The tool main body 16 is moved downward together with the wire 20 and clamps the wire 20 between the end portion 14 thereof and the circumferential edge of the valve seat 10. The clamped wire 20 is arranged to extend across the circumferential edge of the valve seat 10, in this embodiment, and to extend in the radial direction of the valve seat 10. The tool main body 16 is further urged against the valve seat 10 by a predetermined force generated by the driving means 17. When the circumferential surface of the end portion 14 is brought into annular linear contact with the valve seat 10 as shown in FIGS. 2 and 3, downward movement of the tool main body 16 is stopped. The wire 20 clamped in the manner described above is pressed into the circumferential edge of the valve seat 10 before the tool main body 16 stops moving, and an impression 28 of a size corresponding to the diameter of the wire 20 is formed. Since the tool main body 16 is harder than the wire 20, the end portion 14 of the tool main body 16 is not damaged.

According to experiments conducted by the inventor of the present invention, when the material of the wire 20 was spring steel and the diameter was 0.3 mm, the impression 28 as described above was formed in the circumferential edge of the valve seat 10 when the pressing force of the tool main body 16 against the valve seat 10 was 20 kg.

When the downward movement of the tool main body 16 is stopped, the driving means 17 stops applying the driving force to the tool main body 16. Therefore, the tool main body 16 is returned to the start position, as shown in FIG. 1, by the biasing force of the biasing means (not shown) and the tension acting on the wire 20 as described above.

That portion of the wire 20 being held in the vicinity of the tool main body 16 so as to form impressions or grooves in the valve seats 10 a predetermined number of times, and having changed through use from a predetermined diameter, is moved from the end portion 14 of the tool main body 16 toward the collecting means 26 so as to be replaced by a new portion of the wire 20 supplied from the storage means 24.

The above embodiment has been described only for the sake of descriptive convenience and is not intended to restrict the present invention in any manner. Therefore, various changes and modifications which may occur to one skilled in the art are deemed to lie within the scope of the present invention.

For example, the shape of the end portion 14 of the tool main body 16 can be spherical and is preferably the same as that end portion of a valve member used in combination with the valve seat 10.

When the circumference of the valve seat is chamfered and the inclination of the conical surface of the end portion of the tool main body has the same angle as that of the chamfering, the circumferential surface of the end portion of the tool main body is brought into surface contact with the chamfered portion of the valve seat.

The overall tool main body 16 need not have a hardness greater than that of the valve seat 10. Only the end portion 14 thereof need have a hardness greater than that of the valve seat 10 obtained by a hardening means such as quenching.

What is claimed is:

1. A method of forming a groove in an annular valve seat, comprising: detachably clamping a wire in a groove in an end surface of an end portion of a tool; the end portion having a hardness greater than said valve seat, the wire having a hardness greater than said valve seat and extending transverse to a circumferential edge of said valve seat, and moving a circumferential surface of said end portion with said wire thereon with pressure into linear or surface contact with said valve seat and thereby forming a groove in the form of an impression of the wire in the circumferential edge.

2. A method according to claim 1, wherein the wire is a relatively long wire extending from a storage means to a collecting means, and the wire is clamped between said end portion of said tool and said valve seat at a position between said storage means and said collecting means.

3. A tool for forming a groove in an annular valve seat, comprising: a tool main body having an end portion with a circumferential surface of a conical shape, said end portion having a hardened surface, a wire having a hardness at least equal to that of said end portion, and holding means comprising a groove formed in an end surface of said end portion and detachably holding said wire so that said wire extends across said circumferential surface, whereby pressing the tool with the wire thereon into linear or surface contact with said annular valve seat forms a groove in the form of an impression of the wire in said valve seat.

4. A tool according to claim 3, further comprising a storage means for storing a relatively long wire, and a collecting means for collecting a relatively long wire, the wire extending from said storage means to said collecting means and being clamped by said holding means on said end portion at a position between said storage means and said collecting means.

* * * * *